US005540034A

United States Patent [19]

Focke

[11] Patent Number: 5,540,034

[45] Date of Patent: Jul. 30, 1996

[54] PROCESS AND APPARATUS FOR INTRODUCING CIGARETTES OR THE LIKE INTO PACKS

[75] Inventor: Heinz Focke, Verden, Germany

[73] Assignee: Focke & Co. (GmbH & Co.), Verden, Germany

[21] Appl. No.: 550,571

[22] Filed: Oct. 31, 1995

Related U.S. Application Data

[63] Continuation of Ser. No. 231,840, Apr. 25, 1994, abandoned.

[30] Foreign Application Priority Data

Apr. 27, 1993 [DE] Germany ..... 43 13 434.3

[51] Int. Cl.[6] ..... B65B 3/24

[52] U.S. Cl. ..... 53/444; 53/475; 53/150; 53/234; 53/246; 53/258

[58] Field of Search ..... 53/148, 149, 150, 53/157, 234, 236, 246, 258, 260, 444, 452, 458, 466, 473, 475, 579, 563

[56] References Cited

U.S. PATENT DOCUMENTS

| | | | |
|---|---|---|---|
| 2,048,281 | 7/1936 | Muller | 53/150 |
| 2,682,983 | 7/1954 | Ashcroft | 53/151 |
| 3,159,272 | 12/1964 | Swift . | |
| 3,238,698 | 3/1966 | Hollerton | 53/258 |
| 3,513,619 | 5/1970 | Kochalski et al. | 53/148 |
| 3,910,012 | 10/1975 | Schmermund | 53/258 |
| 3,924,386 | 12/1975 | Schmermund | 53/234 |
| 3,946,538 | 3/1976 | Serra . | |
| 4,306,648 | 12/1981 | Manservisi et al. | 53/150 |
| 4,362,235 | 12/1982 | Erdmann | 53/150 |
| 4,528,801 | 7/1985 | Seragnoli et al. | 53/150 |
| 5,035,102 | 7/1991 | Tomanovits . | |

FOREIGN PATENT DOCUMENTS

| | | | |
|---|---|---|---|
| 1241310 | 8/1988 | Canada | 53/260 |
| 522225 | 1/1993 | European Pat. Off. . | |
| 8231810 | 5/1983 | Germany . | |
| 3331745 | 3/1984 | Germany . | |
| 3633865 | 4/1988 | Germany . | |
| 3918236 | 6/1990 | Germany . | |
| 4100792 | 7/1992 | Germany | 53/148 |
| 209124 | 6/1940 | Switzerland . | |
| 240557 | 5/1946 | Switzerland . | |
| 1291024 | 2/1987 | U.S.S.R. . | |
| 103968 | 2/1917 | United Kingdom . | |
| 2104035 | 2/1983 | United Kingdom | 53/444 |
| 455724 | 10/1986 | United Kingdom . | |

*Primary Examiner*—John Sipos
*Assistant Examiner*—Ed Tolan
*Attorney, Agent, or Firm*—Sughrue, Mion, Zinn, Macpeak & Seas

[57] ABSTRACT

Process and apparatus for introducing a cigarette group (11) into a supporting member (14) for positioning the cigarettes (10) at a distance from one another within the pack. For introducing cigarettes (10) or the like into orifices (22) of the supporting member (14), guide tubes (64) serve as guide members for the cigarettes (10), the guide tubes (64) being guided with tube tips (65) through the orifices (22) of the supporting member (14) and the cigarettes (10) then being pushed after in the guide tubes (64). While the unit consisting of a cigarette group (11) and of the supporting member (14) is being pushed out of a cigarette turret (47), folding tabs of the supporting member (14) are folded.

23 Claims, 7 Drawing Sheets

PROCESS AND APPARATUS FOR INTRODUCING CIGARETTES OR THE LIKE INTO PACKS

Figure 1:
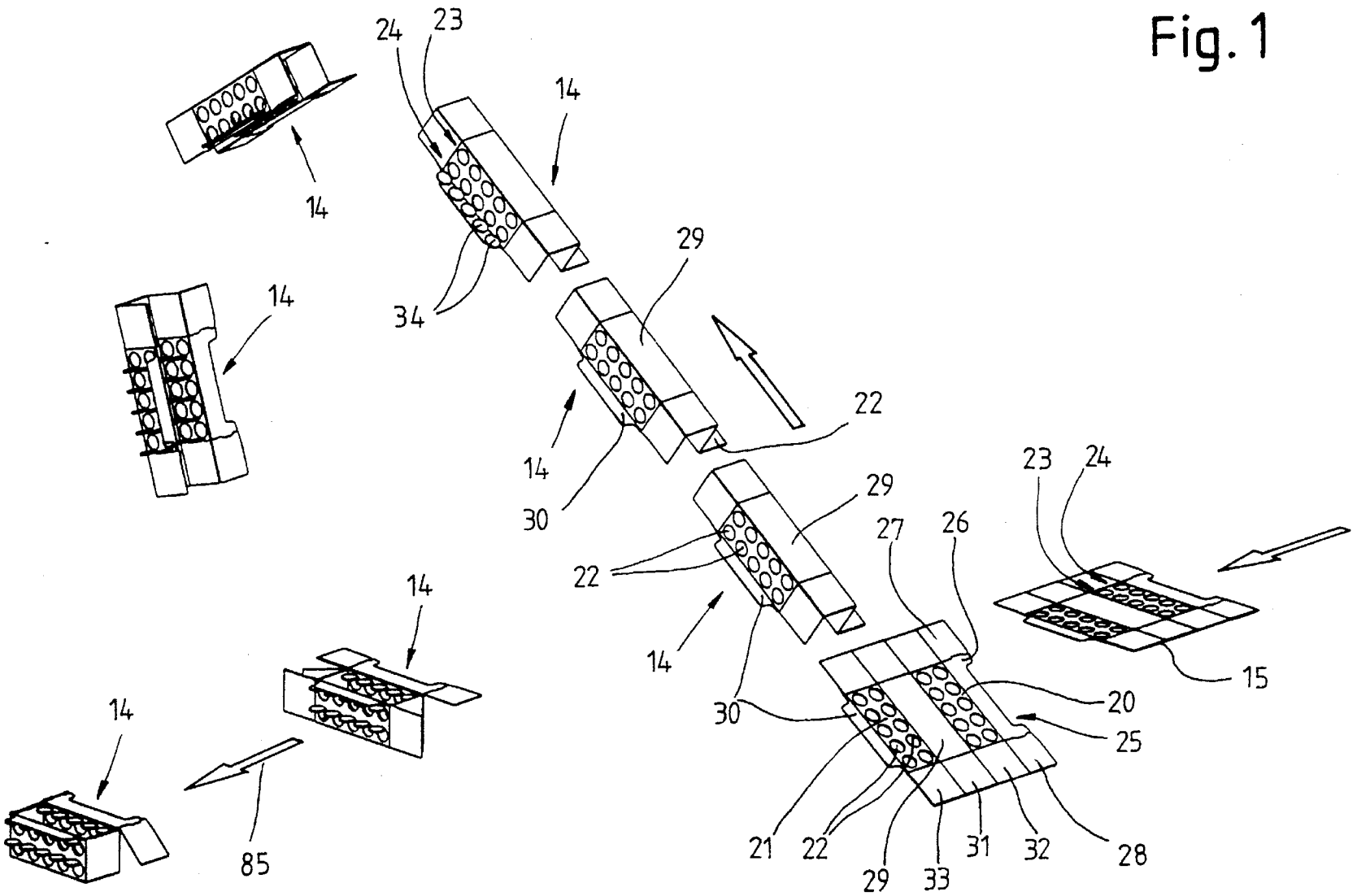

This is a continuation of application Ser. No. 08/231,840 filed Apr. 25, 1994, abandoned.

DESCRIPTION

The invention relates to a process for introducing a group of stick-shaped articles, especially a cigarette group, into a pack, preferably into a hinge-lid pack, the articles being positioned at a distance from one another within the pack. The invention relates, furthermore, to an apparatus for carrying out the abovementioned process.

Hinge-lid packs are in widespread use throughout the world as packaging for cigarettes. During the production and filling of hinge-lid packs of this type, the procedure is such that a cigarette group corresponding to the pack content is assembled separately, is wrapped in an inner blank and is then introduced as a "cigarette block" into the completely or partially ready-folded hinge-lid pack. In the known hinge-lid packs, the cigarettes within the cigarette group are arranged in rows, the cigarettes resting directly, that is to say totally against one another.

The above-described process for the production and filling of hinge-lid packs cannot be employed when, as recently demanded, the cigarettes or other stick-shaped smoker's articles are to be at a specific invariable distance from one another within the pack.

The object on which the invention is based is, therefore, to propose measures which allow an efficient machine-matched filling of hinge-lid packs and similar packs with groups of articles, especially cigarette groups, the cigarettes or the like maintaining a fixed distance from one another within the pack.

To achieve this object, the process according to the invention is characterized in that the group of articles or the cigarette group is combined, in a formation corresponding to the position within the pack, namely in the arrangement in especially two rows, with a supporting member defining the relative position of the cigarettes and is then introduced, as a unit consisting of the supporting member and cigarette group, into the completely or partially finished pack.

In the process according to the invention, during the assembly of a pack-matched cigarette group, the cigarettes are at the same time combined with a supporting member which is designed so that it fixes the cigarettes at a desired distance from one another within the pack. The cigarette group, preferably without an inner wrapping, is then pushed together with the supporting member, as a unit into the pack in a suitable way, before the latter is closed.

The supporting member for the cigarettes of a cigarette group is designed so that each cigarette is assigned an orifice, through which the cigarette has to be partially pushed. For this purpose, the apparatus according to the invention is equipped with guide members, specifically preferably guide tubes, which are matched to the form or shape of the articles, namely cigarettes, and which surround each cigarette at least partially and can be pushed first or together with the cigarettes through the orifices and which, after the desired position of the cigarettes in the supporting member has been reached, can be retracted from the latter.

A further special feature of the apparatus according to the invention is that a largely conventionally designed cigarette magazine is assigned an especially designed cigarette turret which supplies prefolded supporting members, each for receiving a cigarette group, in a function-matched relative position in relation to the push-out region of the cigarette magazine. The cigarettes are fed in rows to the supporting members in the region of the cigarette turret, specifically with the cooperation of the guide tubes. These expediently first pass through the orifices of the supporting member. The cigarettes are thereafter pushed through the associated guide tubes into the necessary relative position. The guide tubes are subsequently retracted into the initial position, so that the cigarette turret can be moved further.

In the further course, the supporting member is (virtually) ready-folded and is then fed together with the cigarette group as a unit to the pack.

Further features of the apparatus according to the invention relate to conveying and folding members for the supporting member, to the design of the cigarette turret, to folding members assigned to the latter, and to the design of the cigarette magazine.

Further particulars of the invention are explained in more detail below by means of an exemplary embodiment of the apparatus according to the invention.

Figure 2:
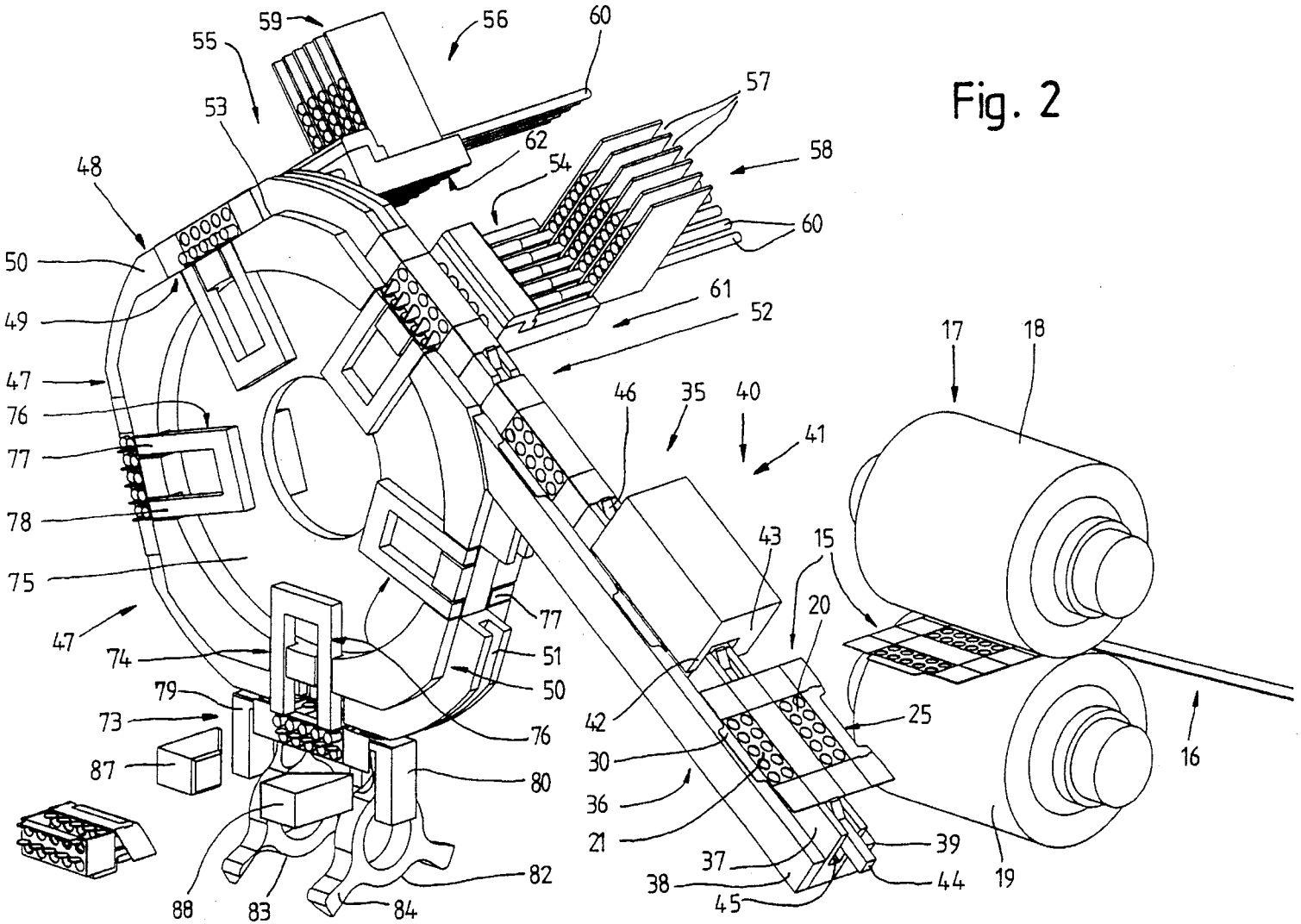
Figure 3:
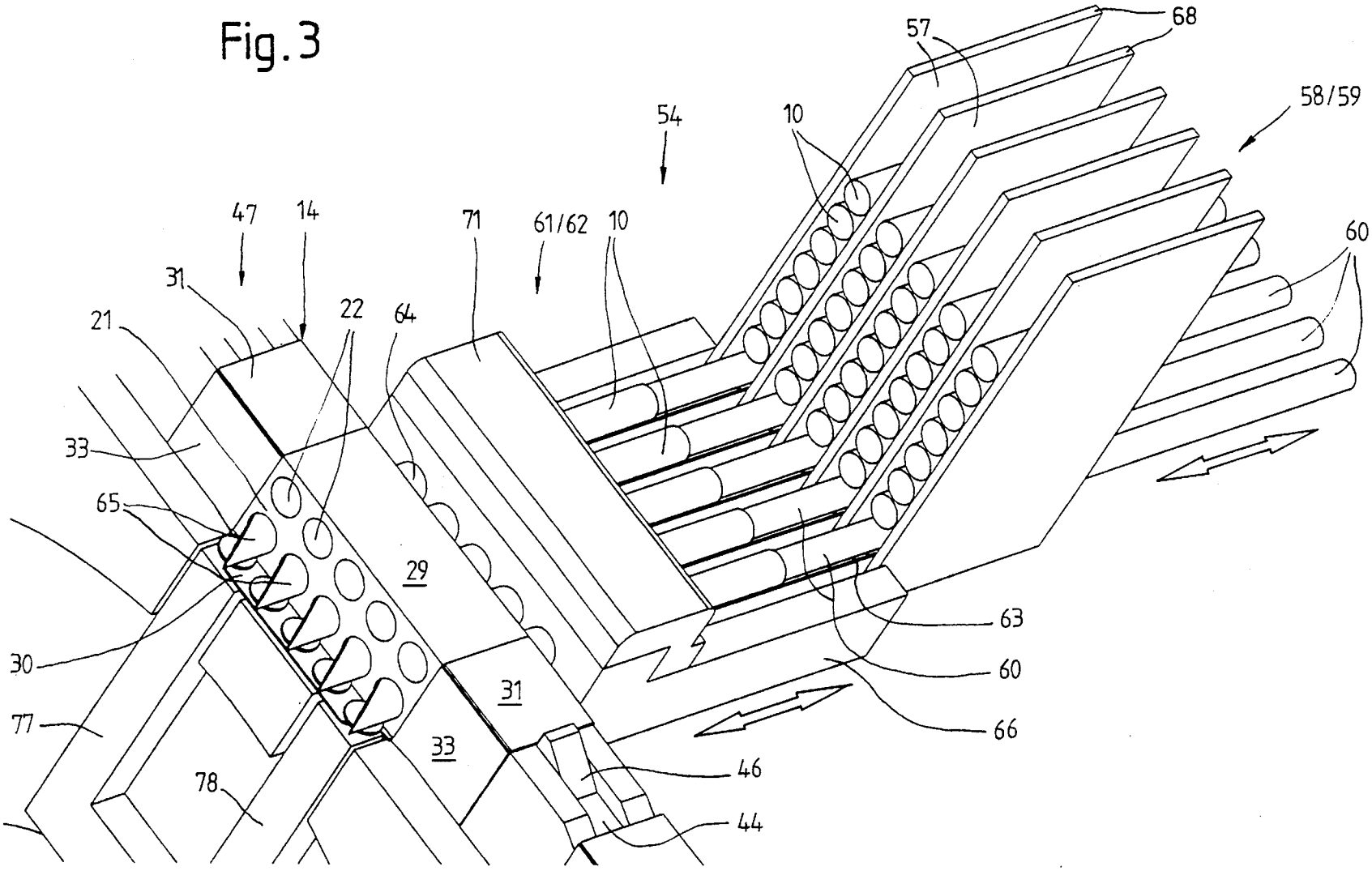
Figure 4:
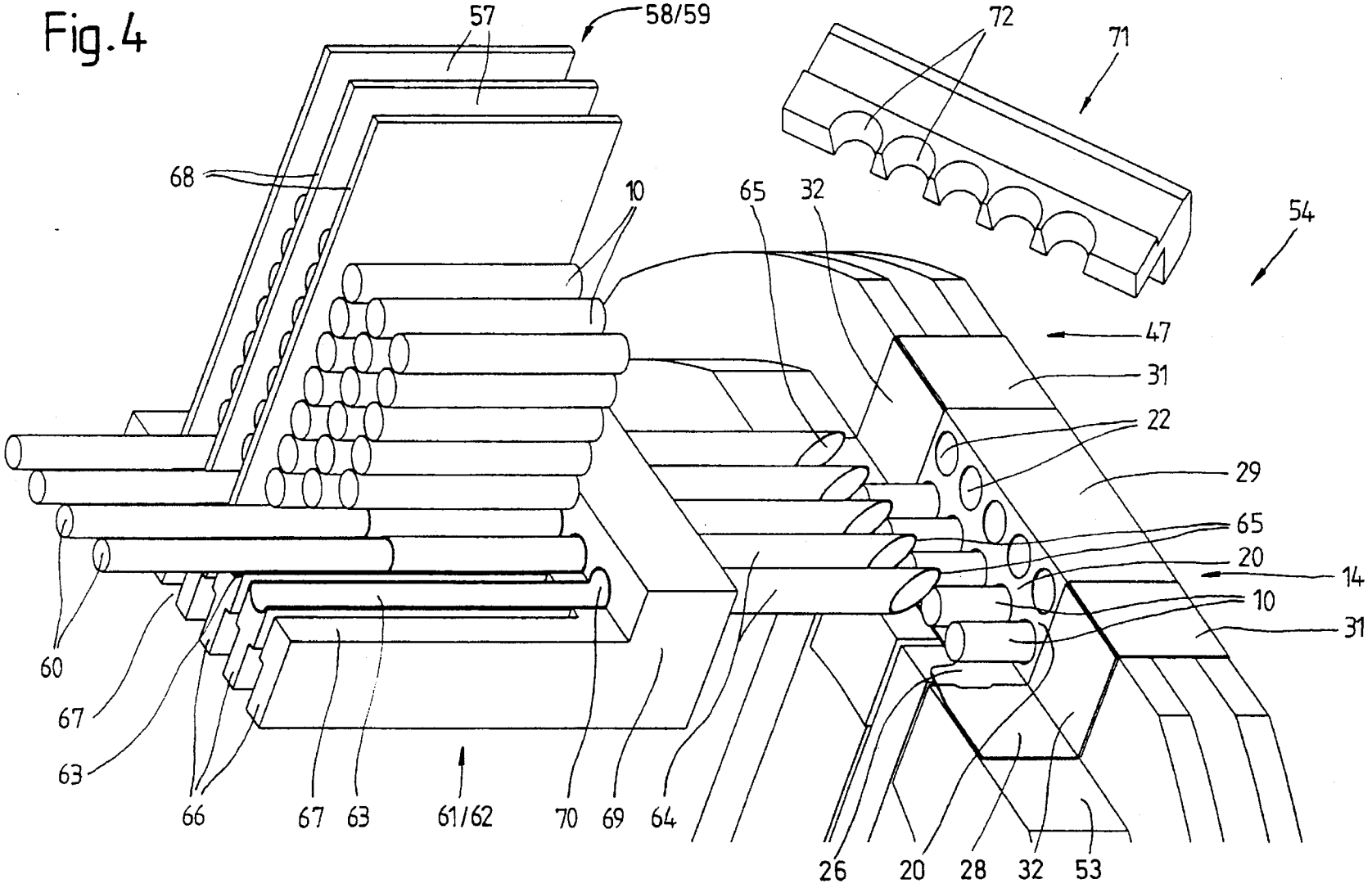
Figure 5:
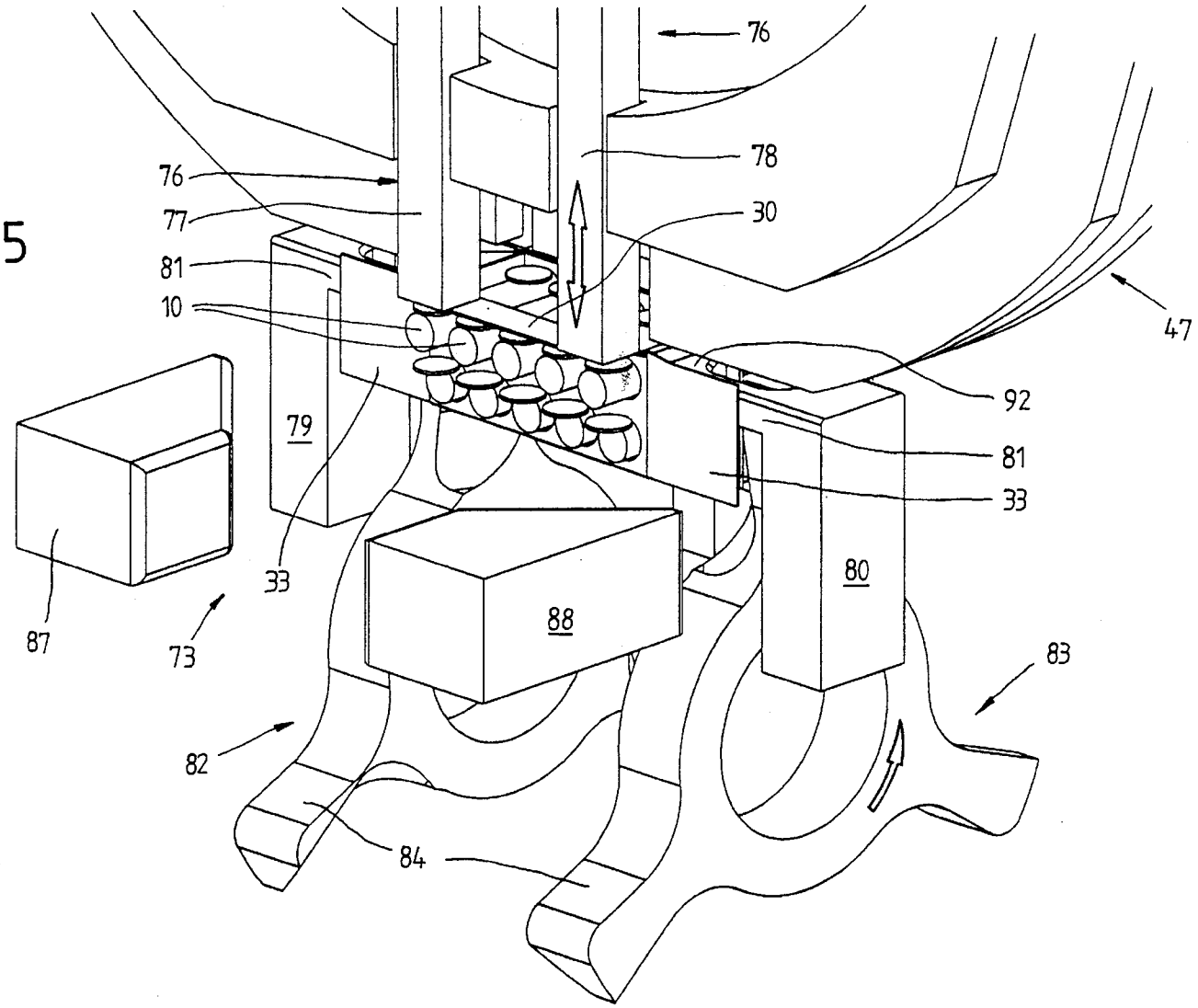
Figure 6:
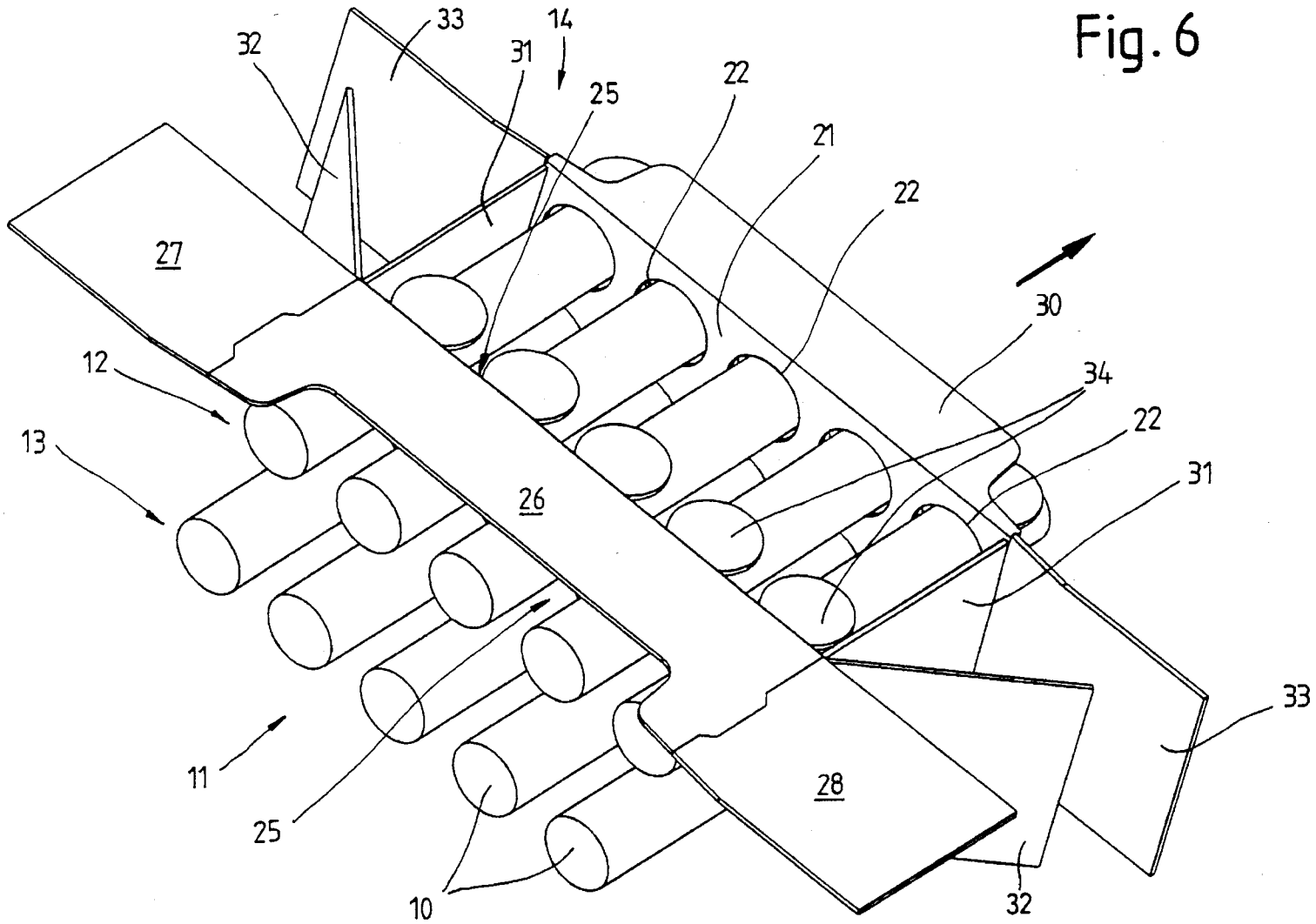
Figure 7:
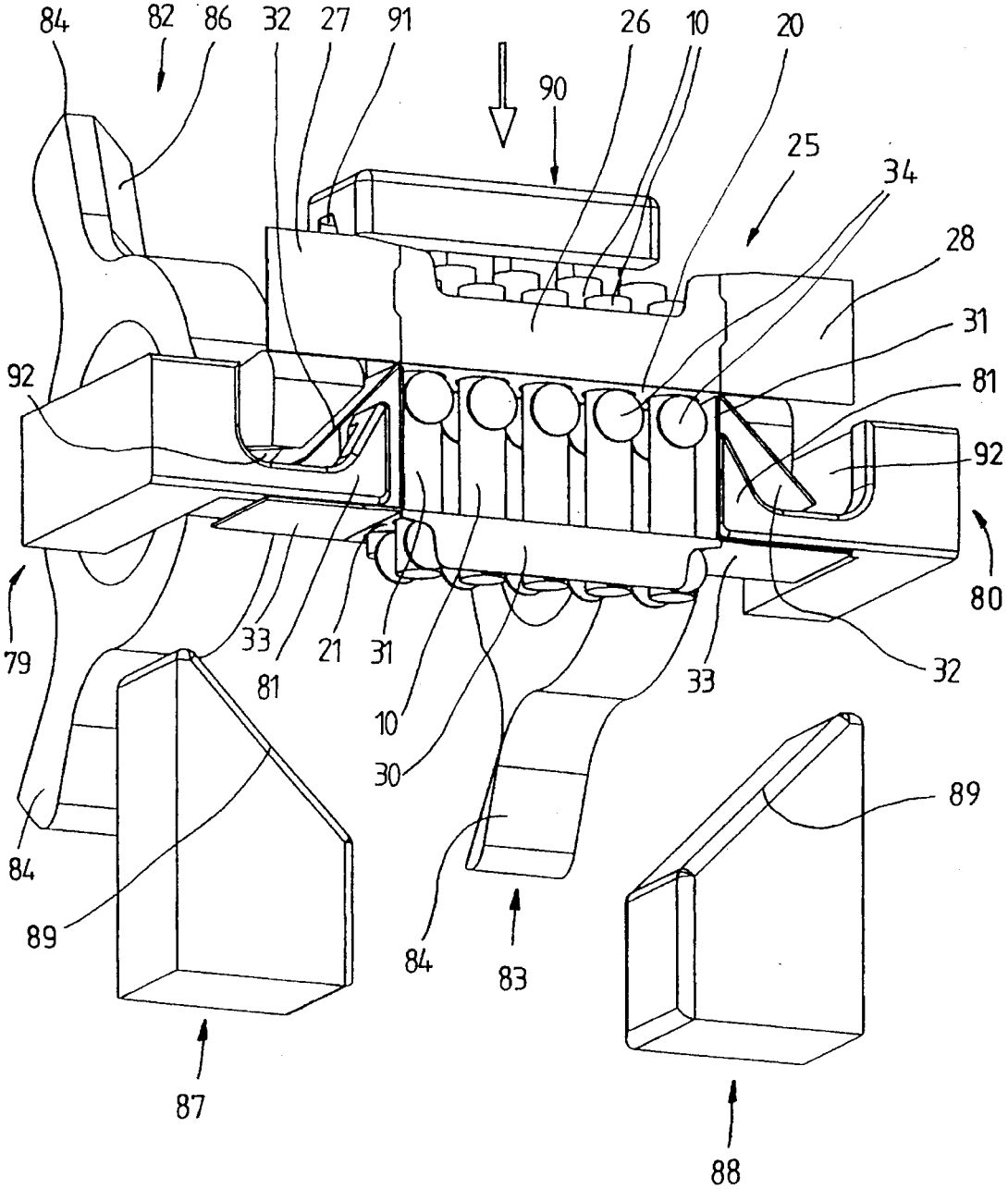

In the drawing:

FIG. 1 shows phases of movement for a supporting member which can be inserted together with cigarettes into a hinge-lid pack, in a perspective representation, FIG. 2 shows important details of an apparatus for folding the supporting member and for introducing cigarettes into the latter, likewise in a perspective representation, FIG. 3 shows a detail of the apparatus according to FIG. 2 in the region of a cigarette magazine, on an enlarged scale, likewise in perspective, FIG. 4 shows the detail according to FIG. 3 in another view with changed members, FIG. 5 shows a lower region of a cigarette turret with folding members, likewise in perspective, FIG. 6 shows a perspective view of a supporting member with cigarettes or with other stick-shaped articles, greatly enlarged, FIG. 7 shows a further detail in the exit region of the cigarette turret as a perspective top view.

The drawings are concerned with the production of part of a pack for elongate stick-shaped articles, namely cigarettes 10 or cigarette-like smoker's articles. A group of these articles, that is to say a cigarette group 11 is to be introduced into a pack (not shown), specifically especially into a hinge-lid pack. In this example, the cigarettes 10 are positioned in two rows 12, 13 in the pack. The cigarettes 10 are maintained at a distance from one another within the rows 12, 13 and from row to row.

There serves for positioning the cigarettes 10 or the cigarette group 11 in a predetermined relative position within the pack a supporting member 14 which is arranged to fit as a separate insert piece within the pack (hinge-lid pack) and which fixes the cigarettes 10. A pack, namely hinge-lid pack, designed in this way is the subject of DE 4,307,386, (corresponding to U.S. application Ser. No. 08/207,175 filed Mar. 8, 1994).

The supporting member 14 consists of a separate blank 15 which is severed free of waste from a material web 16 by punching or cutting, specifically by means of a cutting unit 17 having cutting rollers 18 and 19. The blank 15 is designed so that the supporting member 14 provided by folding has two supporting walls 20, 21 arranged at a distance from one another. These extend at a distance from one another within the pack (hinge-lid pack) transversely to the longitudinal orientation of the cigarettes 10. In order to grasp the cigarettes 10, each supporting wall 20, 21 is provided with orifices 22, each for the passage of one cigarette 10. The orifices 22 are accordingly arranged in two orifice rows 23, 24. The dimensions and contour of the orifices 22 are matched to the shape of the cigarettes 10, namely, in the present case, circular, with a diameter which is slightly larger than the outer diameter of the cigarettes 10.

During the production of a hinge-lid pack equipped with an insert or supporting member 14 of this type, the supporting member 14 is first folded in such a way that the supporting walls 20, 21 assume the position corresponding to the supporting function. A cigarette group 11 is then introduced into the supporting member 14, namely each of the cigarettes 10 into an orifice 22 of each supporting wall 20, 21. The unit thus formed is thereafter finished by folding the supporting member 14 and is fed to a pack.

The supporting member 14 or the blank 15 for this performs a double function, namely at the same time forms a collar 25 conventional in hinge-lid packs for cigarettes. This consists of a collar front wall 26 and of adjoining collar side tabs 27, 28. The collar 25 extends with the collar front wall 26 in the region of a pack front wall and with the collar side tabs 27, 28 in the region of adjoining pack side walls (not shown).

The supporting wall 20 which is the upper in the pack directly adjoins the collar front wall 26 within the blank 15. There follows an intermediate piece 29 which is directed transversely relative to the supporting walls 20, 21 and which is upright in the pack. Connected to this intermediate piece 29 is the second lower supporting wall 21, of which the distance from the upper supporting wall 20 therefore corresponds to the width of the intermediate piece 29. Connected to the free side of the lower supporting wall 21 is a spacer tab 30 which, in the upright position, that is to say transverse to the supporting wall 21, bears on a pack front wall and is supported on a bottom wall of the pack. The spacer tab 30 therefore determines the distance between the lower supporting wall 21 and the bottom of the pack. The contour of the spacer tab 30 matches the conventional contour of the collar front wall 26, so that a waste-free production of the blank 15 is possible in this region.

Folding tabs adjoin the supporting walls 20, 21 and the intermediate piece 29 on both sides, namely an inner tab 31 on the intermediate piece 29, an intermediate tab 32 on the upper supporting wall 20 and an outer tab 33 on the lower supporting wall 21. The abovementioned folding tabs are separated from one another by means of punching cuts. The cutting unit 17 is designed so that the blank 15 is finished completely, including the orifices 22, during transport through between the cutting rollers 18, 19.

The (circular) punching cuts for the orifices 22 are designed so that punched pieces 34 in the form of circular surfaces are held on the blank 15, namely on the edge of the respective orifice 22, by means of a residual connection. This prevents a multiplicity of small pieces of waste from occurring in the region of the packaging machine. During the introduction of the cigarettes 10 into the orifices 22, the punched pieces 34 are moved sideways into a position approximately transverse to the supporting wall 20, 21 (FIG. 6).

The blanks 15, after leaving the cutting unit 17, pass onto a folding track 35 which, in the present case, is rectilinear. In the region of the latter, the first important folding steps are carried out, in such a way that the blank 15 has an essentially U-shaped form in cross-section, with the supporting walls, 20, 21 as legs directed parallel to one another. The collar 25 and the spacer tab 30 are likewise already folded into the end position transverse to the supporting walls 20, 21.

For this purpose, the folding track 35 consists of a profiled guide rail 36. Its profile is approximately T-shaped (FIG. 2). An upwardly directed web 37 serves as a counter-folding member during the folding of the supporting walls 20, 21 relative to the intermediate piece 29. The latter rests on the web 37. Its width therefore corresponds to the width of the intermediate piece 29.

A lower profile widening of the guide rail 36, namely transverse webs 38, 39 located on both sides, serve for support or as a counter-folding member for the collar 25 and the spacer tab 30.

The blank 15 is laid onto the guide rail 36 thus designed, in such a way that the intermediate piece 29 is oriented centrally relative to the web 37. The blank 15 is now transported along the guide rail 36 through a folding station 40. In the region of the latter, the folding track 35 is assigned a folding member 41 movable up and down. The latter is of U-shaped cross-section. It descends onto the blank 15. During this downward movement, the web 37 is surrounded by the folding member 41, the supporting walls 20, 21 at the same time being folded transversely relative to the intermediate piece 29 resting on the web 37. The folding member 41 is moved until folding legs 42, 43 finally press the collar 25 and the spacer tab 30 against the top side of the transverse webs 38, 39. The blank 15 is thereby folded in one operation. After the folding member 41 has been lifted off, the blank is moved one conveying stroke further on the guide rail 36.

A timed conveyor serves for transporting the blanks 15 in the region of the folding track 35 which, in the present example, consists of a conveying rod 44 mounted in the web 37 designed as a hollow profile, namely in an upwardly open slot 45. The conveying rod 44 has a number of drivers 46 on the upwardly directed free side. These are arranged at a distance from one another corresponding to the conveying stroke. The conveying rod 44 is driven to and fro in a suitable way, such that, during each feed stroke, the blanks 15 are moved one position further, namely from a receiving station into the folding station 40 and thereafter into an intermediate station. During the return stroke of the conveying rod 44, the drivers 46 dip into a plane below the blanks 15.

The (partially) folded blanks 15 or supporting members 14 are transferred, after the folding track 35, onto endless conveyors, namely onto a cigarette turret 47. This is designed as a disc and is driven intermittently in rotation in a vertical plane.

The outer circumference of the cigarette turret 47 is designed in a special way. A receptacle, namely a pocket 49 for a respective cigarette group 11, is located in the respective region of a rectilinear portion 48 of the cigarette turret. The pocket 49 is outward, that is to say open on the side which is outer in the radial direction of the cigarette turret 47. The pockets 49 are limited laterally, namely in the circumferential direction, by an edge web 50 which runs all around and which is interrupted in order to form each of the pockets 49. The edge web 50 has the form or cross-sectional profile of the guide rail 36 and is therefore provided with an outwardly open slot 51.

The folding track 35 adjoins the cigarette turret 47 approximately tangentially. In the region of the transfer station 52, the prefolded supporting members 14 are transferred onto the circumference of the cigarette turret 47 by the conveyor of the folding track 35, that is to say by the conveying rod 44 or the drivers 46. The supporting members 14 do not thereby vary the predetermined folding position. In order to preserve this, the cigarette turret is provided on both sides of the edge web 50 with radially set-back steps 53 on both sides of the edge web 50. The spacer tab 30 bears on these steps 53 on one side and the collar 25 on the other side. During the transfer of the supporting member 14 onto the cigarette turret 47, the conveying rod 44 temporarily penetrates into the slot 51 of the cigarette turret 47.

The cigarette turret 47 runs in the upper region through (two) filling stations 54 and 55. In the region of these, the cigarette group 11 is combined with the supporting member 14. The cigarettes 10 are thereby pushed in rows into the orifices 22 of the supporting member 14, specifically a first radially inner row 12 in the filling station 54 which is the first in the direction of rotation and the second radially outer row 13 in the subsequent filling station 55.

The folding track 35 is positioned relative to the cigarette turret 47 in such a way that the supporting members 14 fed in the region of the transfer station 52 are transported into the first filling station 54 by the conveyor, namely by the conveying rod 44. When this position is reached, the conveying rod 44 returns to the initial position.

The filling stations 54, 55 are assigned to a device for the collection and stocking of cigarettes 10 and for the formation of the cigarette groups 11. This is a cigarette magazine 56 of essentially conventional design. Of this, only the lower region is shown, namely magazine shafts 57 which are combined in two shaft groups 58, 59. A shaft group 58, 59 is assigned to each filling station 54, 55. Rows of cigarettes 10 arranged one above the other are located in the individual magazine shafts 57 of the shaft groups 58, 59. A lower layer of cigarettes 10 is simultaneously ejected out of the magazine shafts 57 of each of the shaft groups 58, 59 and, at the same time, is fed to the pockets 49 of the cigarette turret 47, being pushed into the supporting members 14.

Pusher members, namely tappets 60 assigned to each magazine shaft 57, serve for transferring a respective row 12, 13 of cigarettes 10 to the supporting members 14 located in the filling stations 54 and 55. An elongate tappet of circular cross-section penetrates into the lower region of each magazine shaft 57 and pushes the respective lower cigarette 10 out of the magazine shaft 57. Each shaft group 58, 59 is therefore assigned a group of, in the present case, five tappets 60 located next to one another in one plane. These are expediently actuated jointly. A row 12, 13 of five cigarettes is thereby ejected and transferred to the cigarette turret 47.

The cigarette magazine 56 or the shaft groups 58, 59 are arranged at a distance from the plane of the cigarette turret 47. A bridge 61, 62 is located between the shaft groups 58, 59 and the respective pocket 49 of the cigarette turret 47 to be fed. The row 12, 13 is pushed over the respective bridge 61, 62 into the supporting members 14 by the tappets 60.

Each bridge 61, 62 is provided with guides, namely troughs 63, assigned to each cigarette 10. The cigarettes 10 slide in these during transfer to the cigarette turret 47.

In the present exemplary embodiment, the bridges 61, 62 are at the same time members for the preparation of the orifices 22 during the introduction of the cigarettes 10 into the supporting members 14. In point of fact, this involves removing or pivoting punched pieces 34 located in the orifices 22. For this purpose, thrust members designed as hollow bodies are mounted on the bridges 61, 62. These thrust members are guide tubes 64 which are mounted on the bridge 61, 62 in the extension of the troughs 63 on the side facing the cigarette turret 47.

The guide tubes 64 projecting from the bridge 61, 62 and arranged in a row are made extremely thin-walled. The ends are tapered by means of an oblique cut, so that a one-sided tube tip 65 is obtained. By means of these the guide tubes 64 are thrust (jointly) through the orifices 22 in the two supporting walls 20, 21 of the supporting member 14. The guide tubes 64 are moved until the ends facing the tube tips 65 project completely through the supporting wall 21 facing away from the cigarette magazine 56 (FIG. 3).

The relative movement of the cigarette turret 47 in relation to the bridges 61, 62 can be controlled in such a way that the guide tubes 64 or their tube tips 65 already pass through the orifices 22 of the facing supporting wall 20 before the cigarette turret 47 is at a standstill, so that the tube tips 55 strike the punched pieces 34 of these orifices 22 approximately centrally.

After this position of the guide tubes 64 has been reached, the cigarettes 10 of the respective row 12, 13 which are in the same direction as these are pushed through the guide tubes 64 into the pack-matched relative position within the supporting member 14. The guide tubes 64 act as guiding and protecting members for the cigarettes in order to ensure that the cigarettes 10 are displaced relative to the supporting walls 20, 21 without difficulty, since the cigarettes 10 are surrounded completely by the guide tubes 64. After the necessary position of the cigarettes 10 has been reached, the guide tubes 64 are retracted into an initial position. During the retraction of the guide tubes 64, the cigarettes 10 are retained in the specific position within the orifices 22 of the supporting member 14. For this purpose, the tappets 60, which caused the cigarettes 10 to advance into the position described, act as a stop for the cigarettes 10, until the guide tubes 64 are retracted completely.

The cigarette turret 47 can then be moved one station further. In the two filling stations 54 and 55, the guide tubes 64 or their rows are arranged in different planes, so that, in the first filling station 54, the row 12 radially inner in relation to the cigarette turret 47 is pushed in and, in the subsequent filling station 55, the row 13 is pushed in.

The bridges 61, 62 are designed as displaceable guide members for the cigarettes 10 during transfer to the supporting member 14. In the initial position (FIG. 4), the part of the bridge 61, 62 having the troughs 63 is located underneath the shaft groups 58, 59 of the cigarette magazine 56. The relative position is selected so that a trough 63 receiving a particular cigarette 10 is located under each magazine shaft 57.

The bridge 61, 62 is made comb-like in the region of the troughs 63, with a plurality of carrying fingers 66 located next to one another. The top side of these carrying fingers 66 of T-shaped profile is designed as a trough 63. Lower ends of shaft walls 68 for limiting the magazine shafts 57 penetrate into gaps 67 formed between the carrying fingers 66. This guarantees that the cigarettes 10 located in the magazine shafts 57 are deposited on the troughs 63 in a fault-free manner.

In the further course of the movements, the cigarette 10 located in a respective trough 63 is displaced in the axial direction by an associated tappet 60 into the guide tubes 64 adjoining the troughs 63 and finally through the said guide tubes 64. For this purpose, the tappets 60 have a slightly smaller diameter than the cigarettes 10.

During the movements of pushing the lower layer of cigarettes 10 out of the shaft group 58, 59, the bridge 61, 62 too is displaced out of the initial position, shown in FIG. 4, with the troughs 63 under the magazine shafts 57 into the other end position, in which the guide tubes 64 pass with their tube tips 65 through the orifices 22 of the supporting member 14 (FIG. 3). The bridge 61, 62 or its carrying fingers 66 are at the same time located completely outside the region of the magazine shafts 57. The cigarettes 10 rest on the tappets 60. During the return to the initial position, the tappets 60 are retracted completely out of the region of the magazine shafts 57, as soon as the bridge 61, 62 has reached the initial position. The cigarettes 10 can then fall into the troughs 63 as a result of their own weight within the magazine shafts 57.

The guide tubes 64 are connected to the bridge 61, 62 coaxially with the troughs 63 in the region of a pedestal 69. Bores 70 of closed cross-section are formed within the pedestal 69 for the passage of the cigarettes 10. The guide tubes adjoin the bores 70 on the side located opposite the troughs 63.

In the present exemplary embodiment, the bridge 61, 62 is provided in the region of the pedestal 69 with a capping piece 71. This can be produced separately and be attached releasably onto the pedestal 69. The capping piece 71 forms a completion of the upper cross-section of the troughs 63, specifically funnel-shaped entry orifices 72. These entry orifices 72, which form a part profile for the trough 63, are located in a vertical leg of the angular capping piece 71. The entry of the cigarettes 10 into the bores 70 and finally into the guide tubes 64 is made easier by these funnel-shaped entry orifices 72.

The pockets 49, each receiving a unit consisting of a supporting member 14 and of a cigarette group 11, are located in the region of a rectilinear outer contour of the cigarette turret 47. In the upper filling stations 54, 55, the particular pockets 49 affected are directed at an obtuse angle to one another. After the second filling station 55, the pocket 49 of the folding turret runs through an inactive station. The pocket 49, together with the supporting member 14 and cigarette group 11, thereafter passes into the region of a lower push-out station 73. Here, the pockets 49 are directed with the open side downwards. The unit consisting of the cigarette group and supporting member 14 is pushed out of the pocket 49 downwards and is then transported underneath the cigarette turret 47 along a rectilinear discharge-conveyor track according to the arrow 85 to the pack (hinge-lid pack) provided.

Each pocket 49 is assigned a push-out member rotating with the cigarette turret 47, namely a pusher 74 designed as a double pusher. The pusher consists of two radially movable pusher members 76 mounted on both sides of a turret disc 75. Each pusher member is of fork-shaped design, with two pusher fingers 77, 78 arranged at a distance from one another. For pushing a supporting member 14 out of a pocket 49, these come to bear on the transversely projecting part regions of the latter, namely on the collar front wall 26 on the one hand and the spacer tab 30 on the other hand. The cigarettes 10 are therefore not directly subjected to stress by the pushers 74.

During the movement of pushing out of the supporting member 14, a first folding step is executed. For this purpose, there are located in the push-out station 73 outside the range of movement fixed folding members which fold the inner folding tab, namely the inner tab 31 connected to the intermediate piece 29, into the pack-matched position, that is to say into a vertical position, during the downwardly directed pushing-out movement (FIG. 6). The folding members used for this purpose are angularly designed folding pieces 79, 80 on both sides of the push-out path for the supporting member 14. Horizontally directed folding legs 81 cause the erection of the inner tab 31 as a result of the relative movement.

After the cigarette turret 47 has been left, movable folding members, namely folding wheels 82, 83 driven to rotate or revolve, take effect directly underneath this. These are arranged rotationally in vertical plane underneath the cigarette turret 47, likewise on both sides of the push-out path of the supporting member 14. The plane of the rotational movement for folding wheels 82, 83 extends transversely relative to the plane of the cigarette turret 47.

Each folding wheel 82, 83 is provided with a plurality of, in the present case three, radially directed folding arms 84. The drive of the rotating folding wheels 82, 83 is controlled in such a way that each folding arm 84 grasps a respective folding tab located in the rear in the discharge direction according to the arrow 85, namely the intermediate tab 32, and folds it against the already folded inner tab 31. For this purpose, the folding arms 84 are equipped with oblique folding faces 86 which, during the folding movement directed from the rear forwards, each grasp and fold around an intermediate tab 32.

During the discharge movement in the direction of transport according to the arrow 85, the outer tab 33 located at the front in the conveying direction is then folded through 90° until it bears on the intermediate tab 32. Stationary folders 87, 88 having obliquely directed folding faces 89 serve for this purpose. The folding takes place as a result of the relative movement of the supporting members 14 in relation to the stationary folders 87, 88.

The folding pieces 79, 80 or their folding legs 81 are provided with recesses 92 which allow a passage or a free movement of the folding arms 84 of the folding wheels 82, 83. The arrangement is such that, during the downwards movement of the unit consisting of the cigarette group 11 and of the supporting member 14, first the inner tab 31 is folded by the folding legs 81 and immediately thereafter, in the push-out position underneath the cigarette turret 47, the intermediate tabs 32 are folded by the folding arms 84.

During transport to the pack, the collar side tabs 27, 28 still thereafter directed transversely are folded by known folding deflectors which are conventional for this purpose and which are arranged laterally next to the transport track at a fixed location.

For the transport of the unit consisting of the cigarette group 11 and of the supporting member 14 takes place by means of a suitable conveyor. FIG. 7 shows diagrammatically a drive of the (chain) conveyor which grasps the cigarette group on the rear side, namely on end faces located on the collar side.

FIG. 7 shows a further special feature. The cigarettes 10 can be pushed into the supporting member 14 in such a way that the rows 12, 13 are offset relative to one another. In the finished pack, the upper ends of the row 13 located at the rear, that is to say facing a pack rear wall, are in a relatively higher position than the front row 12 facing the collar 25. This step-like offset from row to row is allowed for by the shape of the driver 90 which has a clearance 91 for the entry of the row 13 located at the back in the direction of transport. The step-like relative position of the rows 12, 13 is thus allowed for by a corresponding shape of the driver 90 so that the relative position remains unchanged during the conveying movement.

I claim:

1. An apparatus for producing a unit consisting of a group (11) of stick-shaped elongated articles (10) and a supporting member (14) having a plurality of orifices (22) which hold and relatively position the articles at a distance from one another in a pack, said apparatus comprising:

a) a plurality of guide members (64), one for each article (10), which at least partially surround the articles, and which are adapted to the shape of the articles, (b) wherein the guide members (64) are located at distances from one another which correspond to the positioning of the articles in the orifices (22) of the supporting member;

(c) means for first inserting the guide members (64) through corresponding ones of the orifices (22);

d) means for inserting the articles through the guide members;

e) means for retracting the guide members into a final position outside of the supporting member after the insertion of the articles (10); and f) means for extracting the articles (10) in rows (12, 13) from a cigarette magazine (56), and for feeding the articles to the supporting member (14) by a bridge (61, 62) which is movable to and fro between the cigarette magazine (56) and the supporting member (14), wherein the guide members (64) are guide tubes provided with a tube tip (65) formed at the end of each guide tube by an oblique cut.

2. The apparatus according to claim 1, characterized in that the bridge (61, 62) has, for the articles (10), troughs (63) which are associated with the guide tubes (64) and which are arranged in extensions of the guide tubes (64) and, in a receiving position of the bridge (61, 62), run underneath upper magazine shafts (57) of the cigarette magazine (56), in such a way that a lower article (10) of a magazine shaft (57) passes into one of the troughs (63).

3. The apparatus according to claim 1, further comprising a plurality of tappets (60) which are associated with said guide tubes and which are dimensioned in such a way that the tappets (60) are movable through the guide tubes (64), at the same time taking up articles (10), whilst the tappets (60) displace the articles (10), received by the troughs (63) in the bridge (61, 62), into the guide tubes (64) and, after an end position within the supporting member (14) has been reached, fix the articles (10) in the end position during a retracting movement of the guide tubes (64).

4. An apparatus for producing a unit consisting of a group (11) of stick-shaped elongated articles (10) and a supporting member (14) having a plurality of orifices (22) which hold and relatively position the articles at a distance from one another in a pack, said apparatus comprising:

a) a plurality of guide members (64), one for each article (10), which at least partially surround the articles, and which are adapted to the shape of the articles, b) wherein the guide members (64) are located at distances from one another which correspond to the positioning of the articles in the orifices (22) of the supporting member;

c) means for first inserting the guide members (64) through corresponding ones of the orifices (22);

d) means for inserting the articles through the guide members;

e) means for retracting the guide members into a final position outside of the supporting member after the insertion of the articles (10); and f) a substantially circular turret (47), for supporting a plurality of support members (14), rotating in a vertical plane and having pockets (49), arranged at a distance from one another and each for receiving a supporting member (14), said pockets (49) being arranged on the turret (47) in such a way that supporting walls (20, 21) of each supporting member are arranged transversely to the insertion direction of the articles (10), said walls (20, 21) having orifices for passage of the articles.

5. The apparatus according to claim 1, characterized in that the supporting members (14) are arranged in a U-shaped folding position on the circumference of the circular turret (47), a radially inner collar (25) of each supporting member (14) and an opposite spacer tab (30) bearing on a step (53) of the circular turret (47) transversely to the supporting walls (20, 21).

6. The apparatus according to claim 4, further comprising: means for feeding the supporting members (14) to the circumference of the circular turret (47) along a rectilinear folding track (35); and means for folding planar blanks (15), produced by punching and severing from a material web (16), into a three-dimensional U-shaped form during transport along the folding track (35).

7. Apparatus according to claim 6, characterized in that the folding track (35) has a guide rail (36), the transverse dimensions of which correspond to the dimensions of the supporting member (14) folded in a U-shaped manner, the blanks (15) being foldable by a folding member (41) of U-shaped cross-section cooperating with the guide rail (36).

8. The apparatus according to claim 5, characterized in that each pocket (49) of the turret (47) is assigned a push-out member for the supporting members (14) equipped with articles (10), each push-out member having two pusher fingers (77, 78) on both sides of a turret disc (75) of the turret (47), and in that, during the pushing-out movement, the pusher fingers (77, 78) bearing at a distance from one another on a collar front wall (26) and on the spacer tab (30) on the other hand.

9. The apparatus according to claim 4, further comprising means for pushing units, each consisting of the supporting member (14) and of the cigarettes (10), out of the pockets (49) in a lower position of the latter, lateral folding tabs of the supporting member being foldable, during a downwardly directed pushing-out movement, by fixed folding pieces (79, 80) on both sides of the supporting members (14), said lateral folding tabs comprising inner tabs (31) connected to an intermediate piece (29) of the supporting member (14).

10. The apparatus according to claim 4, characterized in that the circular turret has a push-out station (73) comprising folding members, for the folding of lateral folding tabs of the supporting member (14), which include folding wheels (82, 83) revolving in rotation ad having radially directed folding arms (84) for folding around an intermediate tab (32) which is located on the rear side in the direction of the pushing-off movement.

11. The apparatus according to claim 10, characterized in that there are arranged, laterally relative to the path of movement of the unit, consisting of the cigarettes (10) and the supporting member (14), after the pushing-out of the turret (47), fixed folders (87 and 88) for folding around outer tabs (33) of the supporting member (14) which are located at the front in the direction of movement.

12. A process for introducing a group of stick-shaped elongated articles (10) into a pack, comprising the following steps:

a) first, defining relative positions of the articles (10) of the group in a formation corresponding to positions within the pack;

b) containing the articles of the group with a supporting member (14) to support the articles so that the articles are fixed at a distance from one another;

c) then, introducing a unit consisting of the articles (10) and said supporting member (14) into the pack which is at least partially ready-folded;

in order to fix the relative positions, inserting the articles (10) through matching orifices (22) in at least two supporting walls (20, 21) of the supporting member (14) in the longitudinal direction of the elongated articles; and arranging the supporting walls (20, 21) at a distance from one another in the longitudinal direction of the articles so that the articles are at least doubly held by supporting members.

13. The process according to claim 12, further comprising the steps of:

first partly folding the supporting member (14) from a planar blank (15) so that the supporting walls (20, 21) assume a holding position; and then, combining the articles (10) with the supporting member (14), which is ready-folded thereafter, before the unit consisting of the supporting member and the group is inserted into the pack.

14. A process for introducing a group of stick-shaped elongated articles (10) into a pack, comprising the following steps:

a) first, defining relative positions of the articles (10) of the group in a formation corresponding to positions within the pack;

b) combining the articles of the group with a supporting member (14) comprising at least two supporting walls (20, 21) spaced apart at a distance from one another in a downstream direction parallel to the longitudinal axis of the elongated articles, and pushing the articles in said downstream direction through corresponding orifices (22) in said supporting walls so that the articles are doubly held by the supporting walls (20, 21); and c) thereafter, introducing a unit, consisting of the articles (10) and the supporting member (14), into an at least partially ready-folded pack.

15. An apparatus for producing a unit consisting of a group (11) of cigarettes (10), each having a diameter and a longitudinal axis, and a supporting member (14) comprising two opposing supporting walls which are spaced apart in the axial direction of the cigarettes (10), and each of which has a plurality of orifices (22) which hold and relatively position the cigarettes, arranged in at least two rows, at a distance from one another in a hinged-lid pack, each orifice being dimensioned to accommodate a transverse diameter of a cigarette, said apparatus comprising:

a) a plurality of guide tubes (64), one for each cigarette (10), which are located at distances from one another which correspond to the positioning of the cigarettes in the orifices (22) of the supporting member (14);

b) means for inserting the guide tubes (64) into corresponding ones of the orifices (22) of the supporting member (17);

c) means for supporting the supporting member (14) during insertion of said guide tubes (64) into the orifices (22);

d) means for simultaneously inserting the cigarettes (10) of at least one of the rows into said guide tubes (64) and also into the orifices (22) of said supporting member (14);

e) means for retracting the guide tubes (64) from the orifices and into a final position outside of the supporting member after the insertion of the cigarettes (10); and f) means (60) for retaining the cigarettes (10) in said supporting member (14) while said guide tubes (64) are being retracted from the orifices (22).

16. The apparatus according to claim 15, wherein said retaining means comprises a plurality of tappets (60) which are movable inside said guide tubes (64) and relative to said guide tubes.

17. The apparatus according to claim 15, further comprising a common carrier (61, 62) on which the guide tubes (64) are arranged in a formation that corresponds to the relative positions of the cigarettes (10), the guide tubes (64) being movable to and fro by said common carrier.

18. The apparatus according to claim 17, further comprising a cigarette magazine (56) from which the cigarettes (10) are removed by rows and transferred to said supporting member (14) by said common carrier (61, 62) which moves to and fro between said cigarette magazine (56) and said supporting member (14).

19. The apparatus according to claim 17, wherein said common carrier (61, 62) contains troughs (63) that are associated with said guide tubes (64) and hold the cigarettes (10); and wherein said troughs (63) are arranged in extension of said guide tubes (64) in a receiving position of said common carrier (61, 62), and below magazine shafts (57) of said cigarette magazine (56), in such a way that the lowest cigarette (10) in each magazine shaft (57) always passes into one of said troughs.

20. The apparatus according to claim 15, wherein said means for inserting the cigarettes (10) into said guide tubes (64) comprises a plurality of tappets (60).

21. The apparatus according to claim 15, further comprising a substantially circular turret (47) which supports, on a circumference thereof, the supporting member (14) during insertion of said guide tubes (64).

22. The apparatus according to claim 15, wherein said cigarettes (10) are inserted into said guide tubes (64) after said guide tubes are inserted in the orifices (22).

23. The apparatus according to claim 15, wherein said cigarettes (10) are inserted into said guide tubes (64) before said guide tubes are inserted in the orifices (22).

* * * * *